US005680104A

United States Patent [19]

Slemon et al.

[11] Patent Number: 5,680,104

[45] Date of Patent: Oct. 21, 1997

[54] FIBER OPTIC SECURITY SYSTEM

[75] Inventors: Charles S. Slemon, Encinitas; William Michael Lafferty, Leucadia; Anthony E. Diamond, San Diego, all of Calif.

[73] Assignee: Volution, San Diego, Calif.

[21] Appl. No.: 652,913

[22] Filed: May 31, 1996

[51] Int. Cl.[6] ..... G08B 13/14

[52] U.S. Cl. ..... 340/568; 340/600

[58] Field of Search ..... 340/568, 571, 340/600, 540, 541, 565, 566, 555, 556, 427, 432, 573; 359/187, 179

[56] References Cited

U.S. PATENT DOCUMENTS 3,488,586 1/1970 Watrous et al. .
3,742,947 7/1973 Hashem .
3,794,841 2/1974 Cosentino et al. .
3,986,498 10/1976 Lewis .
4,589,404 5/1986 Barath et al. .
4,812,641 3/1989 Ortiz Jr. ..... 340/600
4,870,952 10/1989 Martinez .
4,878,045 10/1989 Tanaka et al. ..... 340/571

*Primary Examiner*—Jeffery Hofsass
*Assistant Examiner*—Sihong Huang
*Attorney, Agent, or Firm*—Nydegger & Associates

[57] ABSTRACT

An optical fiber security system includes an optical emitter connected to one end of an optical fiber and a detector connected to the other end. A random signal generator triggers the emitter to output a light pulse signal through the fiber. This generator also simultaneously triggers the detector to receive the light pulse signal. A comparator compares the light pulse signal that is received by the detector with an optimum reference to adjust and conform the emitter output with the reference. Also, a monitor determines whether a particular identifiable characteristic of the light pulse signal is within a predetermined range of values. Whenever there is not a simultaneous emission and detection of the light pulse signal, or whenever the light pulse characteristic is outside the predetermined range of values, the system alarms.

21 Claims, 1 Drawing Sheet

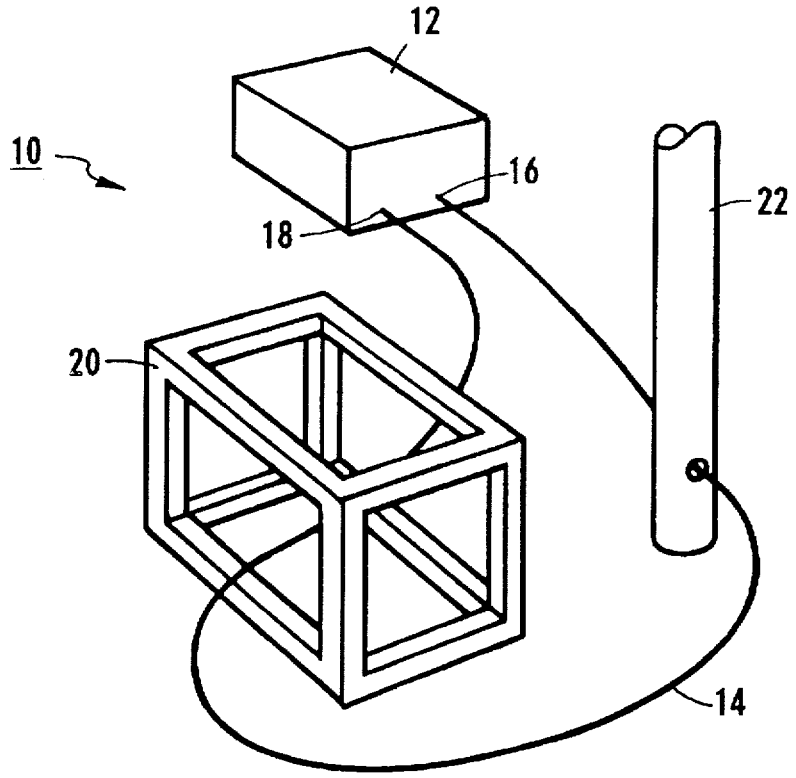
FIG. 1
FIG. 2
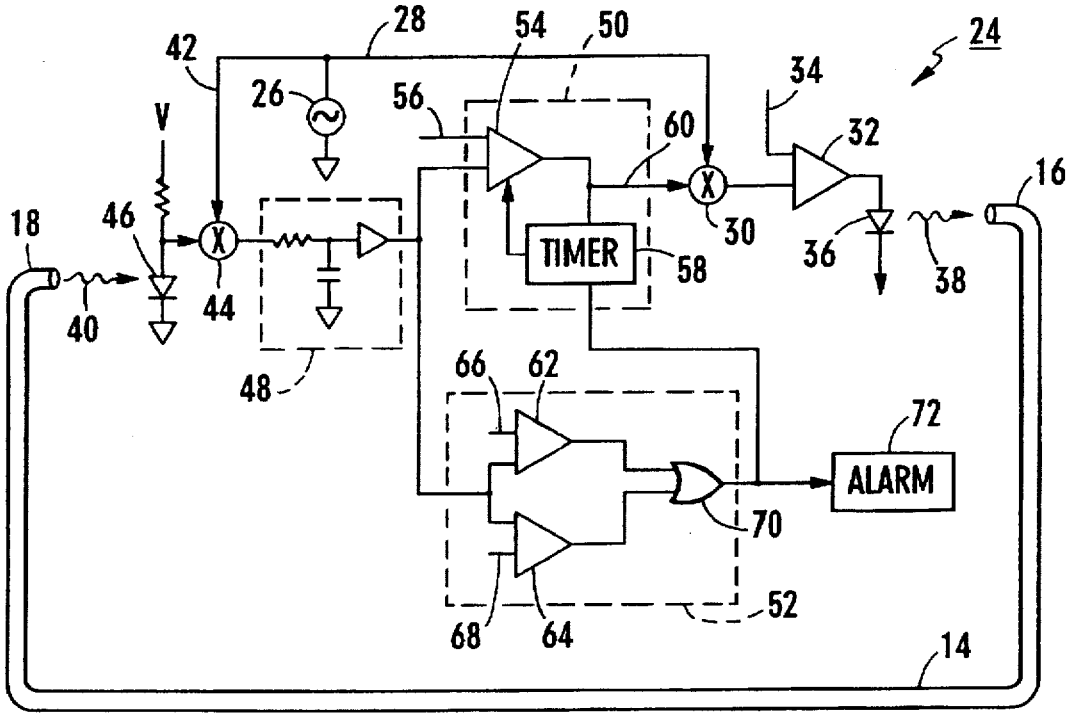

FIBER OPTIC SECURITY SYSTEM

FIELD OF THE INVENTION

The present invention pertains generally to security systems. More particularly, the present invention pertains to security systems which incorporate optical components and light transmission devices to establish a security barrier. The present invention is particularly, but not exclusively, useful as an optical security system which relies on random optical signals and low signal-to-noise ratios for disguising the system's operating characteristics.

BACKGROUND OF THE INVENTION

All security systems rely on the general notion that a barrier needs to somehow be established around whatever it is that needs to be protected. It is, of course, important for the efficacy of a security system that any unwanted disruption of this barrier be positively detected. Depending on the nature of what is being protected, the degree of protection that is desired, and the risk involved, the barrier can be of several different types and can be either very complex or relatively unsophisticated.

One type of security system which is commonly used involves the use of a line or connector which links the object to be protected with a more stable immovable object. For example, bicycles are often secured to fences by a cable, or a length of chain which is secured with a locking device. As another example, display items in showcases are often linked together by a security chord, and the chord is then attached to the case to secure the items in the case. In these examples, security is provided by the mechanical linkage which is created between the object to be protected and another object which is used as an anchor. In order to breach such a system, one must simply break the linkage. More sophisticated systems are often desired.

The degree of protection which is provided by a particular security system will clearly be enhanced by including an alarm in the system which activates whenever the system is compromised. More specifically, for security systems such as those mentioned above which rely on the continued integrity of a line barrier, the alarm needs to somehow be activated whenever the lines' integrity is disrupted. Thus, any attempt to breach such a system requires deception ("spoofing"). This is typically established by installing a pseudo link in the line which will mask the fact that the actual line has been disturbed.

Not all disturbances or perturbations in a security system, however, should cause an alarm. Environmental changes, for instance, although they may physically affect the system will pose no threat to the system. Such changes should be effectively, ignored. Further, some movement of the equipment in the system may pose no threat. Such movement should be tolerated. In view of the fact that not all changes in the security system should be cause for alarm, it is then an objective to create a system which will alarm whenever there is an unexpected change, or the system has somehow changed in an unpredictable manner.

With the above in mind, the more complex security systems are designed with great care to ensure that predictable changes in the system are extremely difficult to duplicate. The typical way this is done is to incorporate secret codes and covert combinations into the system which, if not properly used, will deny access to the system and cause an alarm.

As is well known, optics and fiber optic devices have been successfully incorporated as operative components in many security systems. Typically, such systems are designed to alarm whenever the optical fiber, and hence the light beam passing through the fiber, has been interrupted. Further, in order to make such systems a more effective deterrent, the light which is generated in an optical system is usually encoded in some way. Examples of encoding techniques include periodic pulsing of light signals (digital encoding) or sinusoidal variations in the light beam characteristics (analog encoding). Unfortunately, it happens that if a code can be detected it can be broken. Thus, when a security system relies on a code, if ever the code is found, it can eventually be broken and the system can then be compromised.

In light of the above, it is an object of the present invention to provide a fiber optic security system which relies on an unpredictable random optical input rather than on an encoded input. Another object of the present invention is to provide an optical fiber security system which compensates for environmental variations in the random input as a way to prevent false alarms. Still another object of the present invention is to provide a security system which will alarm whenever an unpredictable change in the system causes the random optical input to either exceed or fall short of respective predetermined thresholds. Yet another object of the present invention is to provide an optical fiber security system in which the random input is discernible despite very low signal-to-noise ratios. Another object of the present invention is to provide an optical fiber security system which is relatively simple to manufacture, easy to use and comparatively cost effective.

SUMMARY OF THE PREFERRED EMBODIMENTS

An optical fiber security system according to the present invention monitors a very noisy random light signal, and determines when unpredictable changes indicate the system has been breached. For this purpose, the security system of the present invention includes a length of optical fiber which has a first and a second end. An emitter, such as a light emitting diode (LED), is optically connected to the first end of the optical fiber, and a detector, such as a photo-diode, is optically connected to the second end of the optical fiber. A random signal carrier is connected to both the emitter and the detector. Specifically, the random signal triggers the emitter to transmit a light signal through the optical fiber. Simultaneously, the same random signal triggers the detector for in-phase synchronous detection of the light signal as it exits the optical fiber.

The fiber optic security system of the present invention also includes a synchronous signal averager which is connected between the detector and a comparator. First, with regard to the averager, it is set with a determinable resistance/capacitor RC time constant and is employed in the system to average and thereby diminish the noise which is present in the light signal received by the detector. This is done over a specific time interval which is determined by the RC value. The result is a light signal which is received from the emitter, during a definable time period, and which has identifiable characteristics due to a much improved signal-to-noise ratio (SNR).

Next, with regard to the comparator, it is electrically connected to the averager and, more specifically, the comparator is electrically connected between the averager and the emitter. The purpose of this comparator is to control selected characteristics for all the light signals which transit the optical fiber and to, thereby, ensure proper operation of the system. Specifically, this is done by monitoring the previously averaged light signals which are received by the detector. As implied above, the light signals themselves can be either digital (pulses) or analog (sinusoidal) in nature. Further, the characteristics of the light signals can include amplitude (brightness), frequency, polarization, phase, repetition rate, pulse width, and wavelength.

To establish control in the comparator, an optimum reference is defined for each characteristic of the light signal that is to be monitored. These optimum references are then stored in an Automatic Light Controller (ALC) in the comparator and the ALC is activated to compensate for normally acceptable drift from the optimum references. In the operation of the security system of the present invention, the ALC compares each optimum reference with appropriately selected characteristics of the light signals as they are received by the detector. By this comparison process, the ALC creates an error signal which is used to appropriately adjust the characteristics of the light signals that are next transmitted from the emitter. As implied here, the error signal will generally indicate small and, therefore, acceptable directions.

In addition to conforming transmitted light signals to optimum reference characteristics, the ALC also has an adjustable time response. This adjustable time response feature of the ALC allows for inconsequential changes in the light signal characteristics, such as environmental changes (temperature, humidity) without disrupting operation of the system. For example, relatively small (slow) changes in the characteristics of the light pulse signals will not adversely affect the operation of the ALC. On the other hand, with the exception of a power-on operation for start-up, relatively large (fast) changes in these characteristics will cause the system to alarm.

The optical fiber security system of the present invention also includes a bi-directional monitor which ensures that the operation of the system remains within certain parameters. To do this, the bi-directional monitor keeps a direct watch on the light signals as they are output from the averager. Importantly, unlike, traditional optical security systems which rely on only the diminution or absence of light (i.e., a lower limit), the bi-directional monitor of the present invention establishes a range of operational values which is defined by both an upper limit and a lower limit. For proper operation of the system, the monitored characteristics of the light pulse signal must fall within this range. Accordingly, anytime a monitored characteristic is above the upper limit (such as when the brightness of light signals is inexplicably increased), or below the lower limit (such as when the light signals cease), the system will alarm.

An additional feature of the security system of the present invention which makes breaching the system more difficult is the introduction of additional random noise. As stated above, the averager is used to eliminate noise and any incoherent signals to thereby improve the SNR for the system. This is accomplished in conjunction with the synchronous in-phase detection of light signals as they are received by the detector. With this synchronous in-phase detection the system, and only the system, knows precisely when and where to look for the desired signal. Stated differently, it is important for the present invention that the carrier bandwidth be much larger than the information bandwidth. For purpose of the present invention, the additional noise which effectively covers the carrier bandwidth can be nothing more than quantum "shot" noise associated with extra light. For example, a large background of constant optical power can be added to the signal to reduce the contrast of the signal.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1 is a perspective view of the fiber optic security system of the present invention shown in an intended environment; and FIG. 2 is a schematic diagram of the electronic circuitry of the present invention.

DESCRIPTION OF THE PREFERRED EMBODIMENT

Referring initially to FIG. 1, the fiber optic security system of the present invention is shown and is generally designated 10. It will be seen and appreciated with reference to FIG. 1 that the system 10 of the present invention includes a circuit box 12 and an optical fiber 14 which is electronically connected to the circuit box 12 via both an input end 16 and an output end 18. Also, it can be seen that the optical fiber 14 is interconnected with a box frame 20 (first object) and with a pole 22 (second object). The box frame 20 and pole 22 are shown here only for exemplary purposes. Indeed, it is to be understood that the present invention is useful with any object which is interconnectable with optical fiber 14.

Referring now to FIG. 2 the electronic circuitry of the present invention is shown schematically and is generally designated 24. It is to be appreciated that this circuitry 24 is physically located in the circuit box 12 shown in FIG. 1.

Included in circuitry 24 is a (truly or pseudo) random signal carrier 26 which is used to generate a signal. At this point it should be noted that the signal which is generated by signal carrier 26 can be either digital in nature (e.g. pulses of energy) or analog in nature (e.g. a sinusoidal wave). In either case, it is important that the signal which is generated by signal carrier 26 be random in nature and hence unpredictable. As shown in FIG. 2, this random signal carrier 26 is connected via a line 28 to a multiplier 30 which, in turn, is connected into a summer 32. Summer 32 also has an access port 34 which can be optionally used to inject additional noise into the circuitry 24. For purposes of the present invention, the additional noise, if used, can be extra light.

Through the connections just described, the random carrier 26 is used to trigger an emitter 36. When so triggered, the emitter 36 generates a transmitted light signal 38. Preferably, the emitter 36 is a light emitting diode LED) of a type well known in the art. Furthermore, as indicated above, the transmitted light signal 38 which is output from the emitter 36 should be quite noisy.

As shown in FIG. 2, from the perspective of optical fiber 14, the transmitted light signal 38 serves as input to the input end 16 of optical fiber 14. In accordance with the intent of the present invention, this transmitted light signal 38 transits the entire length of optical fiber 14 and then exits from the output end 18 of optical fiber 14 as a received light signal 40. As also intended for the present invention, while accounting for normal propagation effects, unless the optical fiber 14 has somehow been compromised, the received light signal 40 will be fundamentally the same as transmitted light signal 38.

Referring back to random carrier 26, it will be seen that, in addition to being connected with multiplier 30 via line 28, a line 42 is used to connect the random carrier 26 with a multiplier 44. In turn, the multiplier 44 is connected to a detector 46 which is preferably a photo electric detector of a type well known in the pertinent art. Thus, the random carrier 26 is electronically connected to both the emitter 36 and the detector 46.

FIG. 2 further shows that the circuitry 24 includes an averager 48 which is connected through multiplier 44 to the detector 46. This averager 48 is of a type well known in the art and has the basic components required to establish a resistor-capacitor (RC) time constant. For purposes of the present invention, the time constant for averager 48 (i.e. the time interval for averaging) should be around one hundredth of a second (0.01 second). It will also be seen that the output of averager 48 is fed to both a comparator 50 and to a bi-directional monitor 52.

Comparator 50 is shown to include an automatic light controller (ALC) 54 which has an input reference 56. More specifically, the input reference 56 is used by ALC 54 to set an optimum reference for each characteristic of the next transmitted light signal 38. For example, values for light beam characteristics such as amplitude, frequency, polarization, phase, repetition rate, pulse width and wavelength can be established and input to ALC 54 via reference 56. As will be appreciated by the skilled artisan, when optical characteristics of the light beam, such as wavelength and polarization are being monitored, an optical detector will need to be incorporated into system 10. Otherwise, a photo detector 46 can be used for electronically measurable characteristics such as amplitude, frequency, phase, repetition rate and pulse width.

For the system 10 of the present invention, the light beam characteristics mentioned above are preset, as desired, by the operator. As will be appreciated by the skilled artisan, and more fully set forth below during the discussion of the operation of the system 10, both the output from averager 48 and the optimum characteristic reference 56 are input to the ALC 54. FIG. 2 also shows that the comparator 50 includes a timer 58 and that the output of comparator 50 is fed via a line 60 into multiplier 30.

The di-directional monitor (BDM) 52 of circuitry 24 is shown to include a high threshold component 62 and a low threshold component 64. Note that the output of averager 48 is served to BDM 52 as an input for both high threshold 62 and low threshold 64. Additionally, high threshold component 62 has an upper limit input 66, and low threshold component 64 has a lower limit input 68. As intended for the present invention, the upper limit input 66 and lower limit input 68 will establish bounds for the optimum reference 56 discussed above. FIG. 2 also shows that the outputs of both high threshold component 62 and low threshold component 64 are input to a gate 70, and that the gate 70 is connected directly to an alarm 72.

OPERATION

In the operation of the system 10 of the present invention, the optical fiber 14 is interconnected with objects that are to be protected, such as the box frame 20 and the pole 22. The ends 16, 18 of optical fiber 14 are then connected in light communication with the circuit box 12. This connection optically aligns the emitter 36 with input end 16 of optical fiber 14 and aligns the detector 46 with output end 18 of the optical fiber 14. The system 10 is then activated.

Upon activation of the system 10, the carrier 26 begins to generate a random signal. As indicated above, this signal can be either digital or analog so long as its behavior is unpredictable. Consider, for example, a sinusoidal wave. This signal will be characterized by any number of parameters, which include all of the characteristics mentioned earlier. Importantly, for the present invention, these characteristics can, and will, vary randomly about a set operating point. This deliberate randomness will occur for various reasons. For instance, environmental conditions such as temperature and aging will vary over time, and these environmental variations will cause the output of carrier 26 to vary accordingly. Also, power variations and other system conditions which are not continuously controlled will also contribute to the randomness of the carrier 26.

It is important for the present invention that the random carrier 26 be connected to both the emitter 36 and to the detector 46. Consequently, whenever the emitter 36 is triggered by a signal from carrier 26, the detector 46 will be simultaneously triggered by this same signal. Thus, there is a synchronous detection feature for the system 10. The result of this is that the light signal 38 is transmitted from emitter 36 at effectively the same instant in time that the light signal 40 is received by detector 46. When necessary, due to the length of optical fiber 14, some adjustment may be made to compensate for the transit time of light through the optical fiber 14. In many cases, however, due to the speed of light, this transit time will be negligible.

As shown, the multiplier 44 receives input from both the random carrier 26 and the detector 46. Thus, if the optical fiber 14 has not been disturbed, the input into multiplier 44 from detector 46 should match its input from random carrier 26. If there is a match, multiplier 44 allows the signal to progress toward the averager 48. On the other hand, if there is no match, multiplier 44 blocks passage of the signal to the averager 48 and the system will alarm. On the other hand, signals which are passed from multiplier 44 to averager 48 are then time averaged by averager 48 in a manner well known in the art. Effectively, this averaging modifies the signals to increase the signal to noise ratio. Stated differently, averager 48 needs to effectively eliminate noise from the carrier bandwidth in the light signal 40 as it is received by detector 46.

The point to be made is that system 10 of the present invention will tolerate certain unpredictable changes, but not others. Specifically, system 10 is designed to accommodate the unpredictable changes which are occasioned by the purely random nature of the electronics signal. These changes are accommodated by the synchronous detection feature of the system 10. Also, system 10 is designed to accommodate unpredictable changes which are caused by environmental factors which cause signals in system 10 to drift or slowly deviate from their preferred values. These changes are tolerated and compensated for by the operation of ALC 54. All other unpredictable changes such as too much light, too little light, or light have untoward characteristics, will cause system 10 to alarm. On top of this, the averages 48 and the bi-directional monitor 52, in combination with other system components, respectively allow system 10 to operate with very low SNR and to alarm when monitored signals extend above, as well as below, a range of predetermined values.

As stated above, the output from averager 48 is fed to both the high threshold component 62 and low threshold component 64 of the BDM 52. There, in combination with each other, the high threshold component 62 and low threshold component 64 compare the output of averager 48 to the respective upper limit value 66 and lower limit value 68. Whenever the output of averager 48 either exceeds the upper limit 66, or falls below the lower limit 68, the gate 70 opens to activate alarm 72.

Consider next the operation of the ALC 54. The averaged signal which is output from averager 48 is sent directly to ALC 54 where it is compared with the optimum reference 56. An error signal, which is created whenever the signal from averager 48 does not compare with the optimum reference 56, is then sent to emitter 36 and the transmitted light signal 38 is appropriately changed. This, of course, occurs only when the error signal is within prescribed limits. Further, the timer 58 is used in a feedback loop for the ALC 54 to allow continued operation of the system 10 so long as changes to the signal received from averager 48 are small and occur over rather long time intervals. Otherwise, the system 10 will alarm. The ALC 54, however, is programmed to allow for the rapid change in signals which will inevitably occur as the system 10 is powered up.

While the particular Fiber Optic Security System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An optical security system which comprises:

an optical fiber having a first end and a second end;

an emitter optically connected to said first end;

a detector optically connected to said second end;

means for generating a signal for triggering said emitter and said detector, said emitter being triggered by said generating means to transmit a pulse having at lease one identifiable characteristic into said first end of said optical fiber, and said detector being simultaneously triggered by said generating means to receive said pulse as said pulse is transmitted from said second end of said optical fiber;

means for comparing said pulse received by said detector with a predetermined reference to provide an output for adjusting said emitter to conform a subsequent said pulse to said reference; and means for monitoring said characteristic of said pulse received by said detector to alarm said system when said received pulse passes a predetermined threshold.

2. A system as recited in claim 1 wherein said emitter is a light emitting diode.

3. A system as recited in claim 1 wherein said detector is a photodiode.

4. A system as recited in claim 1 wherein said predetermined threshold includes a high threshold value and a low threshold value and wherein said alarm is inactive when said characteristic of said pulse is between said high threshold value and said low threshold value.

5. A system as recited in claim 1 wherein said characteristic of said pulse is an amplitude.

6. A system as recited in claim 1 wherein said characteristic of said pulse is a frequency.

7. A system as recited in claim 1 wherein said characteristic of said pulse is a phase.

8. A system as recited in claim 1 wherein said characteristic of said pulse is a wavelength.

9. A system as recited in claim 1 wherein said characteristic of said pulse is a pulse width.

10. A system as recited in claim 1 wherein said characteristic of said pulse is a polarity.

11. A system as recited in claim 1 further comprising means for injecting optical noise into said optical fiber.

12. A system as recited in claim 1 wherein said comparing means further comprises a closed loop feedback for adjusting a time response for said comparing means.

13. A system as recited in claim 12 wherein said time response is dependent on changes in said characteristic of said pulses.

14. A system as recited in claim 13 wherein said time response causes said system to alarm when said characteristic of said pulses exceeds a predetermined value.

15. A system as recited in claim 1 further comprising a multiplier connected between said generating means, said comparing means and said emitter to trigger said emitter when said output of said comparing means substantially matches said signal from said generating means.

16. A system as recited in claim 1 further comprising a multiplier connected between said generating means, said comparing means and said detector to operate said comparing means when said pulse received by said detector substantially matches said signal from said generating means.

17. A system as recited in claim 1 further comprising means for adding shot noise to said system.

18. A method for arming a security system incorporating an optical fiber which comprises the steps of:

generating a random signal;

simultaneously triggering an emitter and a detector with said random signal, said emitter being positioned and triggered to transmit a light pulse having at least one identifiable characteristic through said optical fiber, and said detector being triggered and positioned to receive said pulse;

comparing said pulse received by said detector with a predetermined reference to adjust said emitter to conform a subsequent said pulse to said reference; and monitoring said characteristic of said pulse received by said detector to alarm said system when said received pulse passes a predetermined threshold.

19. A method as recited in claim 18 further comprising the step of controlling said comparing step by allowing for predetermined minor deviations in said characteristic of said light pulse.

20. A method as recited in claim 18 wherein said predetermined threshold includes a high threshold value and a low threshold value and wherein said alarm is inactive when said characteristic of said pulse is between said high threshold value and said low threshold value.

21. A method as recited in claim 18 wherein said characteristics of said light pulse include at least one of an amplitude, a frequency, a phase, a wavelength, a pulse width or a polarity.

* * * * *